US008640684B2

(12) United States Patent
Gur et al.

(10) Patent No.: US 8,640,684 B2
(45) Date of Patent: Feb. 4, 2014

(54) PNEUMATIC LAUNCHER FOR LAUNCHING A PROJECTILE AT A TARGET AND A SUITABLE GUNSIGHT

(71) Applicant: Dr. Erez Gur, Ltd., Kfar Saba (IL)

(72) Inventors: Erez Gur, Kfar Saba (IL); Nir Shvalb, Nesher (IL); Boaz Ben-Moshe, Herzliya (IL)

(73) Assignee: Dr. Erez Gur, Ltd., Kfar Saba (IL)

( * ) Notice: Subject to any disclaimer, the term of this patent is extended or adjusted under 35 U.S.C. 154(b) by 0 days.

(21) Appl. No.: 13/672,093

(22) Filed: Nov. 8, 2012

(65) Prior Publication Data

US 2013/0118466 A1 May 16, 2013

(30) Foreign Application Priority Data

Nov. 10, 2011 (IL) ..... 216276

(51) Int. Cl.
*F41B 11/71* (2013.01)

(52) U.S. Cl.
USPC ..... 124/77

(58) Field of Classification Search
USPC ..... 124/77; 42/105
See application file for complete search history.

(56) References Cited

U.S. PATENT DOCUMENTS

| | | | | |
|---|---|---|---|---|
| 4,689,911 | A * | 9/1987 | White | 42/105 |
| 5,079,987 | A * | 1/1992 | Pate et al. | 89/7 |
| 6,668,699 | B2 * | 12/2003 | Russell | 89/14.05 |
| 7,143,539 | B2 * | 12/2006 | Cerovic et al. | 42/84 |
| 7,337,774 | B2 | 3/2008 | Webb | |
| 7,770,504 | B2 * | 8/2010 | Tippmann et al. | 89/7 |
| 7,966,763 | B1 | 6/2011 | Schneider et al. | |
| 2004/0074381 | A1 * | 4/2004 | Smith | 89/16 |
| 2012/0024278 | A1 * | 2/2012 | Carlson et al. | 124/65 |
| 2012/0024279 | A1 * | 2/2012 | Carlson et al. | 124/66 |
| 2013/0326923 | A1 * | 12/2013 | Gur et al. | 42/1.01 |

FOREIGN PATENT DOCUMENTS

| | | |
|---|---|---|
| FR | 2 875 898 | 3/2006 |
| WO | 98/28587 | 7/1998 |
| WO | 2011/084852 | 7/2011 |
| WO | 2011084852 | 7/2011 |
| WO | 2012/092651 | 7/2012 |

OTHER PUBLICATIONS

Internet website for Parallax Inc., visited Dec. 3, 2013.
Internet website for LaserDyne Technologies, visited Dec. 3, 2013.

* cited by examiner

*Primary Examiner* — Michael David
(74) *Attorney, Agent, or Firm* — The Law Office of Joseph L. Felber

(57) ABSTRACT

Disclosed is a pneumatic launcher and a method for launching projectiles at a target with a distance-dependent launch-power. Also disclosed are a distance-provider and a dynamic gun-sight suitable for use with such a pneumatic launcher.

19 Claims, 4 Drawing Sheets

PNEUMATIC LAUNCHER FOR LAUNCHING A PROJECTILE AT A TARGET AND A SUITABLE GUNSIGHT

RELATED APPLICATION

The present application gains priority from Israel Patent Application IL216276, filed 10 Nov. 2011, which is incorporated by reference as if fully set forth herein.

FIELD AND BACKGROUND OF THE INVENTION

The invention, in some embodiments, relates to the field of pneumatic launchers for launching projectiles at a target, and in some embodiments, to the field of less than lethal projectiles.

In the field of law enforcement, it is known to fire less than lethal ballistic (LTL) projectiles in order to impact a target, for example, to incapacitate the target, to drive the target away or to keep the target at a distance from some location.

Known LTL projectiles include rubber, plastic and beanbag and other projectiles. LTL projectiles effect a target by one or more mechanisms including by force of impact, marking (paint payload), surface agents (including irritants of the skin, eyes, mucosa such as tear gas and capsaicin), injectable agents (tranquillizer darts), and electric shock (XREP by Taser International Inc., Scottsdale, Ariz., USA).

In some cases, LTL projectiles are launched from a suitably-modified lethal weapon, for example, an adaptor is secured to the muzzle of a rifle and an LTL projectile launched from the adaptor with the help of a blank round.

Increasingly, it is preferred to launch LTL projectiles from dedicated launchers. One preferred type of launcher is a pneumatic launcher, a launcher that uses a pressurized propellant gas stored in a reservoir to propel an LTL projectile, for example, the FN303 (FN Herstal, Herstal, Belgium).

A challenge associated with the use of LTL projectiles is that of effective range.

To effectively impact targets at long ranges (greater distances), an LTL projectile must be launched with a high launch-power (typically, high muzzle velocity), a launch-power that necessarily leads to excessively powerful, and potentially injurious, impact at close ranges (short distance).

An LTL projectile can be launched with a low launch-power (typically, low muzzle velocity) to reduce the chance of injurious impact at close ranges, but this renders the LTL ineffective at long ranges.

SUMMARY OF THE INVENTION

The invention, in some embodiments, relates to pneumatic launchers suitable for launching ballistic projectiles with a launch power that is dependent on the distance to a target. In some embodiments, the invention allows the effective launch of a less than lethal projectile with a distance-dependent launch power to any suitable distance with a reduced chance of causing injury, even when used by an unskilled or stressed operator.

In some embodiments, the invention relates to a pneumatic launcher for firing a projectile at a target which launch power is dependent on the distance to the target.

Thus, according to an aspect of some embodiments of the invention, there is provided a pneumatic launcher for launching a projectile at a target, comprising:

a) a chamber configured for holding a projectile (in some embodiments, an LTL projectile) prior to launching;

b) functionally associated with the chamber, a barrel defining a bore configured for guiding a projectile launched from the chamber in a desired direction;

c) a propellant conduit for directing a gas propellant into the chamber to propel a projectile from the chamber and out of the barrel, thereby launching the projectile;

d) functionally associated with the chamber and/or the propellant conduit, a regulating mechanism configured to regulate at least one characteristic of gas propellant that effects a launch power with which a projectile is propelled from the chamber;

e) a digital processor configured to control the regulating mechanism as a function of a distance (e.g., to a target), to propel a projectile with a distance-dependent launch power calculated to impact a target with a desired force; and f) a distance-provider functionally associated with the processor, configured to provide to the processor a distance value wherein the distance value is a distance to an object (e.g., a target) at which the pneumatic launcher is aimed, and wherein the desired force is a force selected to reduce the chance of injurious impact to a target located at a provided distance value.

In some embodiments, the launcher further comprises a dynamic gun-sight functionally associated with the processor, the gun-sight configured to have at least two states, each state indicating a different elevation at which the barrel is to be oriented, wherein the processor is configured to control the state of the gun-sight relative to the launch power.

According to an aspect of some embodiments of the invention, there is also provided a method of launching a less-than lethal projectile at a target, comprising:

a) providing a pneumatic launcher with a barrel and a chamber holding a projectile b) aiming the pneumatic launcher at a target;

c) determining a distance from the pneumatic launcher to where the pneumatic launcher is aimed; and d) subsequent to 'c', releasing a gas propellant into the chamber of the pneumatic launcher to launch the projectile through the barrel not more than about 0.5 seconds (in some embodiments, not more than about 0.2, about 0.1 and even not more than about 0.05 seconds) after the determining of the distance, wherein the characteristics of the gas propellant released into the chamber are at least partially based on the determined distance, so that the launch power with which the projectile is propelled from the chamber is such that the projectile impacts the target with a desired force selected to reduce the chance of injurious impact.

In some embodiments of the method, the characteristics of the gas propellant released into the chamber are additionally determined based on at least one other factor selected from the group consisting of ambient temperature, chamber temperature, ambient pressure and barrel elevation.

In some embodiments of the method, the characteristics of the gas propellant released into the chamber are additionally determined based on whether or not said pneumatic launcher is aimed at a face, especially a human face.

In some embodiments of the method, determining a distance from the pneumatic launcher to an object at which the pneumatic launcher is aimed ('c') is a repeated determination at a distance-determining rate prior to the releasing ('d'); and the releasing a gas propellant into the chamber of the pneumatic launcher to launch the projectile through the barrel ('d') is based on a most-recently determined distance.

In some embodiments, the distance-determining rate is not less frequent than about 1 Hz, not less frequent than about 5 Hz, not less frequent than about 15 Hz, not less frequent than about 30 Hz, not less frequent than about 40 Hz, not less frequent than about 60 Hz, not less frequent than about 80 Hz, not less frequent than about 100 Hz and even not less frequent than about 200 Hz.

Unless otherwise defined, all technical and scientific terms used herein have the same meaning as commonly understood by one of ordinary skill in the art to which the invention pertains. In case of conflict, the specification, including definitions, will take precedence.

As used herein, the terms "comprising", "including", "having" and grammatical variants thereof are to be taken as specifying the stated features, integers, steps or components but do not preclude the addition of one or more additional features, integers, steps, components or groups thereof.

As used herein, the indefinite articles "a" and "an" mean "at least one" or "one or more" unless the context clearly dictates otherwise.

As used herein, when a numerical value is preceded by the term "about", the term "about" is intended to indicate +/−10%.

BRIEF DESCRIPTION OF THE FIGURES

Some embodiments of the invention are described herein with reference to the accompanying figure. The description, together with the figure, makes apparent to a person having ordinary skill in the art how some embodiments of the invention may be practiced. The figure is for the purpose of illustrative discussion and no attempt is made to show structural details of an embodiment in more detail than is necessary for a fundamental understanding of the invention. For the sake of clarity, some objects depicted in the figure are not to scale.

In the Figures.

DESCRIPTION OF SOME EMBODIMENTS OF THE INVENTION

Figure 1:
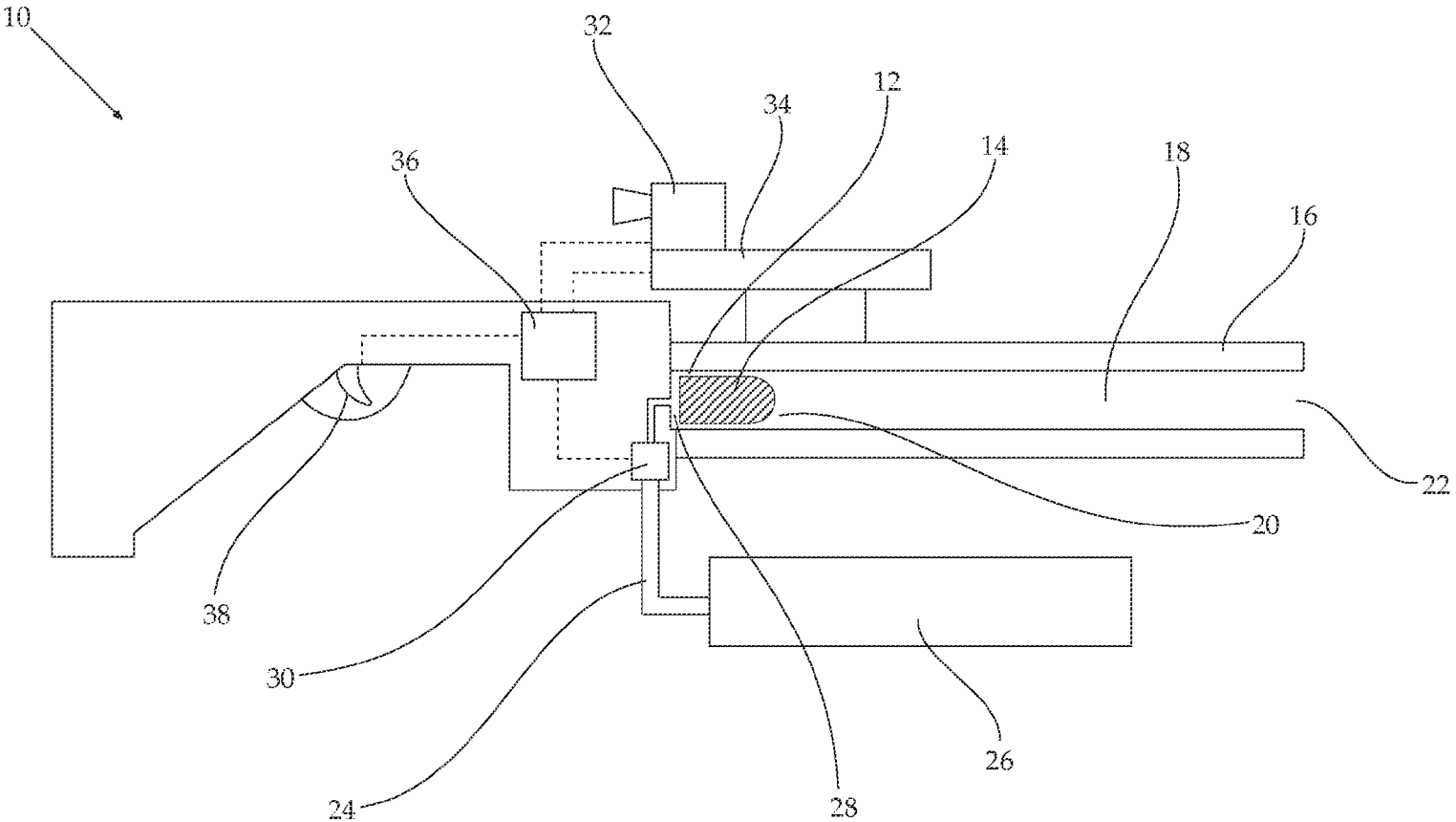
FIG. 1 is a schematic depiction of an embodiment of a pneumatic launcher for launching a projectile at a target according to the teachings herein.

The invention, in some embodiments, relates to pneumatic launchers suitable for launching ballistic projectiles with a launch power that is dependent on the distance to a target. In some embodiments, the invention allows the effective launch of a less than lethal projectile with a distance-dependent launch power to any suitable distance with a reduced chance of causing injury, even when used by an unskilled or stressed operator.

In some embodiments, the invention relates to a pneumatic launcher for firing a projectile at a target which launch power is dependent on the distance to the target.

As discussed above, it would be useful to be able to effectively launch LTL projectiles at targets any useful distance, that is to say, at short distances with a reduced probability of injurious impact and at long distances with sufficient efficacy.

In some embodiments, the invention herein relates to a device that is substantially a pneumatic launcher which launch power is dependent on the distance to a target.

In some embodiments, when used the pneumatic launcher determines a distance to a target and determines a launch power that is dependent on the determined distance, the launch power calculated for effective, but less-injurious, impact force. In a typical embodiment, with all other things being equal, a pneumatic launcher according to the teachings herein propels a projectile with lesser launch power (and typically lower muzzle velocity) at targets located at short distances and propels a same projectile with greater launch power (and typically higher muzzle velocity) at targets located at greater distances.

The principles, uses and implementations of the teachings of the invention may be better understood with reference to the accompanying description and figures. Upon perusal of the description and figures present herein, one skilled in the art is able to implement the teachings of the invention without undue effort or experimentation.

Before explaining at least one embodiment of the invention in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

Thus, according to an aspect of some embodiments of the invention, there is provided a pneumatic launcher for launching a projectile at a target, comprising:

a) a chamber configured for holding a projectile (in some embodiments, an LTL projectile) prior to launching;

b) functionally associated with the chamber, a barrel defining a bore configured for guiding a projectile launched from the chamber in a desired direction;

c) a propellant conduit for directing a gas propellant into the chamber to propel a projectile from the chamber and out of the barrel, thereby launching the projectile;

d) functionally associated with the chamber and/or the propellant conduit, a regulating mechanism configured to regulate at least one characteristic of gas propellant that effects a launch power with which a projectile is propelled from the chamber;

e) a digital processor configured to control the regulating mechanism as a function of a distance (e.g., to a target), to propel a projectile with a distance-dependent launch power calculated to impact a target with a desired force; and f) a distance-provider functionally associated with the processor, configured to provide to the processor a distance value wherein the distance value is a distance to an object (e.g., a target) at which the pneumatic launcher is aimed, and wherein the desired force is a force selected to reduce the chance of injurious impact to a target located at a provided distance value.

In some embodiments, characteristic of gas propellant that the regulating mechanism is configured to regulate is at least one characteristic selected from the group consisting of the pressure of a gas propellant directed into the chamber and/or an amount of a gas propellant directed into the chamber.

In some embodiments, a characteristic of the propellant that the regulating mechanism is configured to regulate is pressure of gas propellant directed into the chamber. In a typical such embodiment, the processor causes the regulating mechanism to increase the pressure of the propellant directed into the chamber to increase launch power (and muzzle velocity) when the distance-provider provides a distance value corresponding to a greater distance to an object at which the launcher is aimed (e.g., a target), allowing effective impact of a more distant target, and the processor causes the regulating mechanism to decrease the pressure of the propellant directed into the chamber to decrease launch power (and muzzle velocity) when the distance-provider provides a distance value corresponding to a lesser distance to an object at which the launcher is aimed (e.g., a target), allowing less injurious impact of a closer target. In some such embodiments, the regulating mechanism comprises a variable pressure regulator (for example, as known in the art of SCUBA diving) under control of the processor for reducing the pressure of propellant conveyed from a propellant reservoir to the chamber and valve having: a closed state blocking the propellant conduit thereby preventing gas propellant from entering the chamber; and an open state allowing gas propellant to enter the chamber through the propellant conduit. In some such embodiments, the processor controls the regulator to change (increase or decrease) the pressure conveyed to the chamber as a function of the distance value received by the distance-provider.

In some embodiments, a characteristic of the propellant that the regulating mechanism is configured to regulate is the amount of gas propellant directed into the chamber (depending on the embodiment, in addition to or instead of propellant pressure). In a typical such embodiment, the processor causes the regulating mechanism to increase the amount of the propellant directed into the chamber to increase launch power (and muzzle velocity) when the distance-provider provides a distance value corresponding to a greater distance to an object at which the launcher is aimed, allowing effective impact of a more distant target, and the processor causes the regulating mechanism to decrease the amount of the propellant directed into the chamber to decrease launch power (and muzzle velocity) when the distance-provider provides a distance value corresponding to a lesser distance to an object at which the launcher is aimed, allowing less injurious impact of a closer target.

In some such embodiments, the regulating mechanism comprises a valve having: a closed state blocking the propellant conduit thereby preventing gas propellant from entering the chamber; and an open state allowing gas propellant to enter the chamber through the propellant conduit. In some such embodiments, the period of time the valve is in the open state effects an amount of gas propellant directed into the chamber and thereby the launch-power, and the processor is configured to control the period of time the valve is open as a function of a distance value provided by the distance-provider.

The projectile is typically provided as a component of a round. In some embodiments, the round in its entirety is the projectile. In some embodiments, a portion of the round remains in the launcher and only a portion of the round is propelled from the launcher as a projectile. The projectile is any suitable projectile, especially an LTL projectile. Any suitable LTL projectile may be launched, including projectiles that effect a target by force of impact (e.g., beanbags, baton rounds), marking (paint payload, stench payload), surface agents (including irritants of the skin, eyes, mucosa such as tear gas and capsaicin, as well as adhesives), injectable agents (tranquillizer darts), and electric shock (XREP by Taser International Inc., Scottsdale, Ariz., USA).

The chamber is a component defining a hollow in which a projectile is held prior to launching. The hollow is in fluid communication with the bore of the barrel. In some embodiments, the chamber is a component distinct from the barrel. In some embodiments, the chamber is or comprises a proximal portion of the barrel. Typically, a projectile held in the chamber faces, and in some embodiments is at least partially located in, the proximal part of the bore of the barrel.

The propellant conduit defines fluid communication between a propellant reservoir (typically reversibly associable with the propellant conduit) and the chamber, specifically, allowing gas propellant to pass from the reservoir through the conduit and into the chamber.

The distance-provider is configured to provide the processor with a distance value, for example, to an object at which the launcher is aimed, e.g., a target. In some embodiments, the distance-provider determines the distance value and provides the determined distance value to the processor. In some embodiments, distance determination is substantially continuous. In some embodiments, distance determination is on-demand, for example, when an operator chooses to determine the distance or to fire the launcher. In some embodiments, the distance-provider provides the distance value to the processor continuously. In some embodiments, the distance-provider provides the distance value on-demand, for example, when an operator chooses to fire the launcher.

The processor (typically an appropriately-configured custom or general-purpose microprocessor such as commonly found on communication devices such as the 1.5 GHz dual core Snapdragon S3 by Qualcomm (San Diego, Calif., USA found in the Galaxy S II by Samsung Electronics (Samsung Town, Seoul, South Korea)) receives the distance value and determines (e.g., by calculation, by retrieving a stored value) a setting for the regulating mechanism that is suitable to propel a projectile with a suitable launch-power that is dependent on (and varies with) the distance value received from the range determiner, that is typically representative of the actual distance to a target. Specifically, a suitable launch power is a launch-power required for the projectile to reach the target with sufficient velocity so that the impact is sufficient for a desired effect but not too strong as to be excessively injurious.

As understood from the above, the launcher is configured to propel a projectile with a distance-dependent launch power allowing the projectile to impact a target with a desired force. In such a way, the launcher can propel a projectile at a close target with a reduced chance of causing injury and also propel a projectile at a distant with sufficient power to have a desired effect.

An advantage of some embodiments of the launcher is an exceptionally long effective range compared to comparable known pneumatic launchers. Typically, known pneumatic launchers have a relatively limited effective maximal range due to the desire to avoid injurious impact at closer distances: the launch power of known pneumatic launchers is limited and a propelled projectile has a relatively low velocity. To reach far distances, the projectile must be fired with a steep trajectory. In LTL situations, a target easily sees the slow projectile in a high trajectory and due to the long flight time is able to move aside and avoid impact. Additionally, a steep trajectory necessitates that an operator fire when the launcher is held with a high barrel elevation, making aiming very difficult even for a skilled operator, especially under high-stress situations. In contrast, some embodiments of a launcher according to the teachings herein have a greater effective range than similar prior art launchers, providing the ability to effectively hit targets at greater distances. To launch a projectile at a distant target, the processor controls the regulating mechanism to provide a high launch-power allowing launch with a low barrel elevation, imparting the projectile with a high-velocity low-trajectory that is relatively easy for an operator to aim and relatively difficult for a target to avoid, increasing the chance of effectively impacting the target with sufficient force.

An additional advantage of some embodiments of a launcher according to the teachings herein is that of safety. In some embodiments the processor is configured to prevent launching of the projectile even if the device is triggered if the distance value received by the distance provider indicates a distance closer than some minimum distance. Such embodiments prevent accidental firing of the launcher, for example, during close-quarters encounters, when the launcher is aimed at the ground or a wall or if the operator trips or falls to the ground.

In some preferred embodiments, the launcher is man-portable and useable, that is to say, the launcher is configured to be carried and operated by a single person. In some embodiments, the launcher is in the form of a firearm, e.g., a riot-gun, or is configured to be mounted on an existing firearm, for example, through a Picatinny rail, in both cases in some embodiments analogous to an FN303 pneumatic launcher by FN Herstal (Herstal, Belgium).

In some embodiments, the launcher further comprises a trigger functionally associated with the processor and the distance-provider, configured so that when the trigger is activated, the distance-provider determines a distance value (e.g., to an object at which the launcher is aimed such as a target), provides the determined distance value to the processor and the processor controls the regulating mechanism to propel a projectile with a distance-dependent launch power. In order to increase the chance that the projectile is propelled with a launch power to impact a target with a desired force, it is preferred that the launcher and components thereof (distance-provider and/or digital processor and/or regulating mechanism) are configured so that the propelling of the projectile is shortly after the trigger is activated, in some embodiments not more than about 0.5 seconds, not more than about 0.2 seconds, not more than about 0.1 and even not more than about 0.05 seconds after the trigger is activated.

In FIG. 1, an embodiment of a pneumatic launcher according to the teachings herein, launcher 10, is schematically depicted.

Launcher 10 includes a chamber 12, in FIG. 1 depicted holding a projectile 14 prior to launching and a barrel 16 defining a bore 18 configured for guiding projectile 14 launched from chamber 12 in a desired direction from proximal end 20, through bore 18 to distal end 22 and out of barrel 16 towards a target.

A propellant conduit 24 is configured to direct a gas propellant from a propellant reservoir 26 (a cylinder of compressed air) into a proximal end 28 of chamber 12 behind projectile 14. The passage of propellant to chamber 12 is normally prevented by valve 30 (a piezoelectric valve) in a closed state.

Launcher 10 further includes gun-sight 32, distance-provider 34 (a laser range finder), processor 36 and trigger 38.

For use, a operator aims at a target through gun-sight 32 and activates trigger 38.

Activation of trigger 38 causes distance-provider 34 to determine the distance to the target and to report the determined distance value to processor 36.

Processor 36 determines a suitable valve opening-time based on the determined distance value and controls valve 30 to be in an open state for the valve opening time. Valve 30 is opened in less than 0.1 seconds after the operator activates trigger 38.

While valve 30 is in the open state, gas propellant from reservoir 26 passes through propellant conduit 24 to enter proximal end 28 of chamber 12. The pressure in chamber 12 caused by the influx of propellant thereinto propels projectile 14 from chamber 12, through bore 18 to distal end 22 and out of barrel 16 towards the target.

Distance-Provider

Any suitable distance-provider may be used in implementing the teachings herein. For example, in some embodiments, a distance-provider is analogous to, similar to or a modified version of a DLE50 professional laser range finder (Robert Bosch GmbH, Gerlingen, Germany) or a Prosport 450 Laser Rangefinder (Bushnell Corporation, Overland Park, Kans., USA).

In some embodiments, the distance-provider includes an image acquirer configured to acquire an image of a target at which the barrel is aimed. In some such embodiments, the distance-provider includes a light-source oriented so that a reflection of a beam of light produced by the light source from an object at which the launcher is aimed is detectable by the image acquirer, in some embodiments, allowing calculation of a distance value to an object at which the launcher is aimed from a reflection detected by the image acquirer. Such distance-providers include some embodiments of the distance-provider discussed in detail hereinbelow.

In some such embodiments, the distance-provider provides the image to the processor, and the processor is configured to determine the presence of a face (especially a human face) in the image (for example, using methods known in the art of digital photography, for example as implemented in the PowerShot SX10IS by Canon, Ôta, Tokyo, Japan); and the processor is configured to control the regulating mechanism also based on the detection of a face in the image, typically reducing the launch power to avoid injurious impact, and in some embodiments preventing any firing of a projectile when a face (especially a human face) is detected.

In some typical uses of a pneumatic launcher according to the teachings herein, for example in typical LTL launch situations, the distance to a target at which the pneumatic launcher is aimed changes rapidly due to the motion of many different targets in a given target area and along the line of fire of the pneumatic launcher. In some embodiments, a distance-provider is configured to determine a distance, e.g., to where the pneumatic launcher is aimed, at a distance-determining rate not less frequent than about 1 Hz, not less frequent than about 5 Hz, not less frequent than about 15 Hz, not less frequent than about 30 Hz, not less frequent than about 40 Hz, not less frequent than about 60 Hz, not less frequent than about 80 Hz, not less frequent than about 100 Hz and even not less frequent than about 200 Hz. In some such embodiments, when the distance-provider is activated, the distance-provider substantially continuously (e.g., at a rate not less frequent than about 1 Hz, about 5 Hz, about 15 Hz, about 30 Hz, about 40 Hz, about 60 Hz, about 80 Hz, about 100 Hz and even about 200 Hz) determines the distance to where the pneumatic launcher is located and substantially continuously provides the determined distance value to the processor, allowing substantially continuously (e.g., at a rate not less frequent than about 1 Hz, about 5 Hz, about 15 Hz, about 30 Hz, about 40 Hz, about 60 Hz, about 80 Hz, about 100 Hz and even about 200 Hz) controlling the regulating mechanism and launch power. Such high-rate distance determination allows the pneumatic launcher to rapidly adjust the launch-power with which a projectile is propelled, in some embodiments rendering the launcher both safer and more effective. Some such embodiments allow the time between when the trigger is activated and the projectile is propelled from the launcher to be short, as discussed above.

In some embodiments the trigger has at least two user-determined states:

a distance-determining state where the distance-provider repeatedly determines a distance value at a distance-determining rate (as discussed above); and a firing state, wherein the processor controls the regulating mechanism to propel a projectile with a distance-dependent launch power based on a distance value most-recently determined by the distance-provider. In some such embodiments, the launcher and components thereof (distance-provider and/or digital processor and/or regulating mechanism) are configured so that the propelling of the projectile is soon after the trigger enters the firing state, in some embodiments not more than about 0.5 seconds, not more than about 0.2 seconds, not more than about 0.1 and even not more than about 0.05 seconds after the trigger enters the firing state.

For example, a user aims such an embodiment of a launcher at a target and softly depresses the trigger to a distance-determining state where the distance-provider is activated to repeatedly determines a distance value to objects at which the launcher is aimed at a distance-determining rate (e.g., 60 Hz). As long as the operator maintains the trigger in the distance-determining state, the distance-provider repeatedly determines a distance value at the distance-determining rate, provides the processor with the determined distance value and the processor calculates a corresponding regulating mechanism state. The determined distance varies, inter alia, as a result of the motion of the target or objects (e.g., non-target persons) that pass between the launcher and the target. When the operator decides to launch the projectile (there is a clear shot, a target takes an action that warrants launch), the operator depresses the trigger further to a firing state, thereby launching the projectile in accordance with the teachings herein.

Propellant Reservoir

In some embodiments, the launcher further comprises a propellant reservoir (typically a metal or polymer container such as a tank or balloon) functionally associated with the propellant conduit. When the launcher is activated to launch a projectile, gas propellant held in the reservoir passes from the reservoir, through the propellant conduit into the chamber and applies a force that propels a projectile from the barrel of the launcher. Any suitable propellant can be used in implement the teachings herein, for example propellants known in the art of pneumatic launchers. In some embodiments, the propellant reservoir contains a compressed gas (e.g., air, nitrogen) as a propellant. In some embodiments, the propellant reservoir contains a volatile liquid and a gas (e.g., $CO_2$), where the gas is the propellant.

Dynamic Gun-Sight

As is known to a person having ordinary skill in the art, changing the launch power also changes the ballistic trajectory of a propelled projectile. The change in trajectory is especially significant for launchers having low-muzzle velocities (e.g., typical LTL launchers having a muzzle velocity of less than 100 m/sec) and especially significant at greater distances. Operators of known pneumatic launchers estimate the barrel elevation required to hit a target, but often the desired target is missed.

In order to increase the chance that a projectile propelled by a pneumatic launcher according to the teachings herein impacts a desired target, in some embodiments, the launcher further comprises a dynamic gun-sight functionally associated with the processor, the gun-sight configured to have at least two states, each state indicating a different elevation at which the barrel is to be oriented, wherein the processor is configured to control the state of the gun-sight relative to the launch power. In some embodiments, a dynamic gun-sight has a finite number of discrete states. In some embodiments, a dynamic gun-sight has a continuity of states.

A dynamic gun-sight is implemented in any suitable manner. In some embodiments, especially when the distance-provider includes an image-acquirer, a gun-sight is implemented as an image display screen (e.g., LED, LCD, CCD) that provides an image of the area where the target is found with a reticle (of any suitable shape) implemented as illuminated pixels, where the state of the gun-sight is the location of at least a portion of the reticle relative to the image. In some such embodiments, the processor is configured to vertically displace at least a portion of the reticle relative to the image as a function of the distance to the target. As is clear to a person having ordinary skill in the art, such a gun-sight state with a reticle relatively high in the image leads to a lower barrel elevation (flatter trajectory, suitable to hit nearby targets with a projectile) and a reticle relatively low in the image leads to a higher barrel elevation (steeper trajectory, suitable to hit more distant targets).

During use, the processor determines the state of the gun-sight required so that the barrel of the launcher is elevated such that a projectile launched with the desired launch power hits a target at the distance provided by the distance provider. As is known in the art of gun-sights, an operator elevates the barrel of the launcher with reference to the state of the gun-sight and then launches the projectile, so that the projectile is launcher with the correct trajectory.

In such embodiments, launching is a multi-step process. A operator aims at a target and activates a trigger to activate the distance-provider (e.g., pulls the trigger partially, as known in the art of auto-focus photography). The distance-provider determines the distance to the target and provides the determined distance value to the processor. The processor determines a desired launch power that allows impacting the target with a desired force and a barrel elevation allowing hitting the target. The processor determines the gun-sight state that corresponds to the determined barrel elevation, e.g., vertically displaces the reticle. The operator then changes the barrel elevation so that the displaced reticle is superimposed on the target and then activates the trigger to fire a projectile.

Additional Aiming Parameters

As noted above, the processor controls the launch power of a projectile dependent on a distance value related to the distance to a target, and in some embodiments also controls the state of a dynamic gun-sight. In some embodiments the launch power and, if relevant, the state of a dynamic gun-sight, is determined based on parameters in addition to a distance value.

Ambient Temperature

The ambient temperature at which a launcher according to the teachings herein is operated is any temperature, typically between −4° C. and 45° C. Such a distance of temperatures may cause a significant change in performance of any pneumatic launcher, including launch power. Accordingly, in some embodiments, the processor is configured to control the regulating mechanism, to achieve a desired launch power, also based on the ambient temperature. In some embodiments, the launcher further comprises an ambient thermometer functionally associated with the processor, configured to measure and provide an ambient temperature to the processor; and the processor is configured to control the regulating mechanism also as a function of the ambient temperature.

Chamber Temperature

The temperature of the chamber prior to launching of a projectile can change due to the effect of ambient temperature, but also due to temperature changes caused by a previous launching, as a propellant charge cools the chamber while expanding to propel a projectile. Such a temperature change may cause a change in performance of a pneumatic launcher. Accordingly, in some embodiments, the processor is configured to control the regulating mechanism, to achieve a desired launch power, also based on the chamber temperature. In some embodiments, the launcher further comprises a chamber thermometer functionally associated with the processor, configured to measure and provide a chamber temperature to the processor; and the processor is configured to control the regulating mechanism also as a function of the chamber temperature.

Ambient Pressure

The ambient pressure at which a launcher according to the teachings herein is operated varies according to various factors such as weather and geographical location (elevation). The expected range of pressures may cause a significant change in performance of a pneumatic launcher. Accordingly, in some embodiments, the processor is configured to control the regulating mechanism, to achieve a desired launch power, also based on the ambient pressure. In some embodiments, the launcher further comprises an ambient pressure barometer (e.g., as found in a Casio Pathfinder wristwatch) functionally associated with the processor, configured to measure and provide an ambient pressure to the processor; and the processor is configured to control the regulating mechanism also as a function of the ambient pressure.

Barrel Elevation

As is known to a person having ordinary skill in the art, barrel elevation influences the trajectory of a projectile fired from a barrel, and gravity effects a steep trajectory (e.g., a trajectory of a projectile aimed at a target in a tree) differently than a shallow trajectory (e.g., a trajectory of a projectile aimed at a target at level). Accordingly, in some embodiments, the processor is configured to control the regulating mechanism, to achieve a desired launch power, also based on the barrel elevation. In some embodiments, the launcher further comprises a barrel elevation provider (e.g., an accelerometer as found in a typical smartphone such as a Galaxy S II by Samsung Electronics (Samsung Town, Seoul, South Korea)) functionally associated with the processor, configured to measure and provide a barrel elevation to the processor; and the processor is configured to control the regulating mechanism also as a function of the barrel elevation.

Projectile Type

As is known to a person having ordinary skill in the art, factors such as the shape, size and mass of a projectile influence the trajectory of the profile. In some pneumatic launchers (e.g., FN303 by FN Herstal, Herstal Belgium), it is known to standardize the shape, size and mass of all the projectiles to be launched from the same launcher to ensure that the trajectories are the same. Such standardization is not always feasible or desirable. Accordingly, in some embodiments, the processor is configured to control the regulating mechanism, to achieve a desired launch power, also based on the projectile (ammunition) type. In some embodiments, the projectile type is provided to the processor by a operator, for example, using an operator-launcher interface (e.g., touch screen). In some embodiments, a launcher includes a projectile-type sensor functionally associated with the processor to detect the type of projectile held in the chamber and to provide the detected projectile-type to the processor. In some embodiments, projectiles are encoded with an identification code (optical bar code, RFID, magnetic code, electronic circuit) readable by a projectile-type sensor, Target Type As is known to a person having ordinary skill in the art, various targets have different susceptibilities to the same projectile. For example, a projectile such as a tranquilizer dart or an electroshock projectile (e.g., XREP by Taser International Inc., Scottsdale, Ariz., USA), launched with a launch power sufficient to effectively penetrate the skin of a rhinoceros may injure a kangaroo, but such a projectile launched to safely penetrate the skin of a kangaroo will not effectively penetrate the skin of a rhinoceros. Accordingly, in some embodiments, the processor is configured to control the regulating mechanism, to achieve a desired launch power, also based on the target type. Accordingly, in some embodiments, the target type is provided to the processor by a operator to the processor, for example, using an operator-launcher interface (e.g., touch screen).

Embodiment of Distance-Provider

As noted above, any suitable distance-provider may be used in implementing the teachings herein. That said, in some embodiments a distance-provider according to the teachings herein is preferred. The distance-provider is a variant of the distance-provider of the Inventors described in UK patent application 1020616 filed 6 Dec. 2010 and published as PCT publication WO 2012/077039

In some embodiments, a distance-provider as described hereinbelow used in implementing the teachings herein is compact and suitable for mounting on a man-portable launcher according to the teachings herein without substantially increasing the bulkiness of the launcher.

In some embodiments, a distance-provider as described hereinbelow used in implementing the teachings herein is mounted on a launcher so that the distance determined is along a line that is very close to the bore axis (linear displacement of distance provider line of sight from bore axis is low), reducing the chance of line of sight obstruction or mistakes in ranging, in some embodiments not more than about 10 cm, not more than about 7 cm, not more than about 5 cm, and even not more than about 3 cm. In some embodiments, such a distance-provider is mounted on the barrel (as opposed to the body) of a launcher.

In some embodiments, a distance-provider as described hereinbelow used in implementing the teachings herein is robust and not easily damaged or misaligned by shocks and impacts typical to LTL launching situations.

In some embodiments, a distance-provider as described hereinbelow used in implementing the teachings herein is easily and accurately aligned with the barrel of the launcher using a laser bore sighting device.

In typical LTL launching situations, as well as other situations, there is potentially rapid movement of targets at various distances. Accordingly, it is preferred that during a launching process a distance value to a target be repeatedly determined. Some embodiments of a distance-provider as described hereinbelow are exceptionally useful by allowing rapid and substantially continuous determination of a distance value, depending on a frame rate. Accordingly, in some embodiments where a distance-provider as described hereinbelow is used in implementing the teachings herein, the distance-provider is configured for determining a distance value at least about 5 times a second, at least about 15 times a second, at least about 30 times a second, at least about 40 times a second, at least about 60 times a second, at least about 80 times a second, at least about 100 times a second, and even at least about 200 times a second.

In some embodiments where a distance-provider as described hereinbelow is used in implementing the teachings herein, includes a telephoto lens, allowing determination of a distance value with sufficient accuracy at greater distances, e.g., greater than 10 m, greater than 30 m and even greater than 50 m.

In some embodiments where a distance-provider as described hereinbelow is used in implementing the teachings herein, it is preferred that the distance-provider be configured to acquire an image, allowing implementation of embodiments discussed hereinabove.

According to a feature of some embodiments of the invention there is also provided distance-provider for determining a distance, comprising:

a) a portable housing having a front end and an axis;

b) physically associated with the housing, a light-source configured for projecting a beam of light through a light-source aperture in a direction not more than about 2° divergent from parallel to the axis;

c) physically associated with the housing, a light-detector configured to detect light projected by the light-source, reflected from a reflecting object (e.g., a target) located at a distance from the front end between a minimum distance and a maximum distance and entering through a light-detector aperture, at a frame rate where a detection location of the light reflected from a reflecting object on an epipolar line of the light-detector is dependent on the distance to the reflecting object; and d) functionally associated with the light-detector, a distance provider configured to produce a signal related to the detection location, and thereby a distance to the object, at a reporting rate; the signal suitable for being provided, as a distance value, to the processor of the pneumatic launcher described herein.

wherein the light-source aperture and the light-detector aperture are separated by an inter-aperture separation of not more than about 5 cm wherein along the epipolar line between the detection location of light reflected from a reflecting object at the minimum distance and the detection location of light reflected from a reflecting object at the maximum distance there are at least about 20 distinct detection locations, and wherein the signal is different for each of the at least about 20 distinct detection locations.

In some embodiments, the inter-aperture separation is not more than about 4 cm, not more than about 3 cm, not more than about 2 cm and even not more than about 1 cm. In some embodiments, the inter-aperture separation is between about 5 cm and about 0.5 cm, and in some embodiments between about 3 cm and about 1 cm.

The minimum distance and the maximum distance may be any pair of distances that are suitable for the intended use of the distance-provider. Generally, the minimum distance and the maximum distance are selected so that the distance-provider is useful for propelling a projectile from the pneumatic launcher. In some embodiments, the minimum distance is not more than about 1.2 m, not more than about 1 m and even not more than about 0.8 m. In some embodiments, the maximum distance is at least about 5 m, at least about 10 m, and even at least about 50 m.

The basic physical principle by which embodiments of the distance-provider determines distance value to impart to a human operator is epipolar geometry, that is to say the difference in view that two spaced-apart points have on the same volume. These principles are discussed with reference to FIGS. 2A and 2B and are also discussed in U.S. Pat. No. 5,487,669 as well as by Yuan D and Manduchi R (Dept. Comp. Eng., U. California, Santa Cruz, USA, described in Proceedings of the 2004 and the Proceedings of the 2005 IEEE Computer Society Conference on Computer Vision and Pattern Recognition).

Figure 2A:
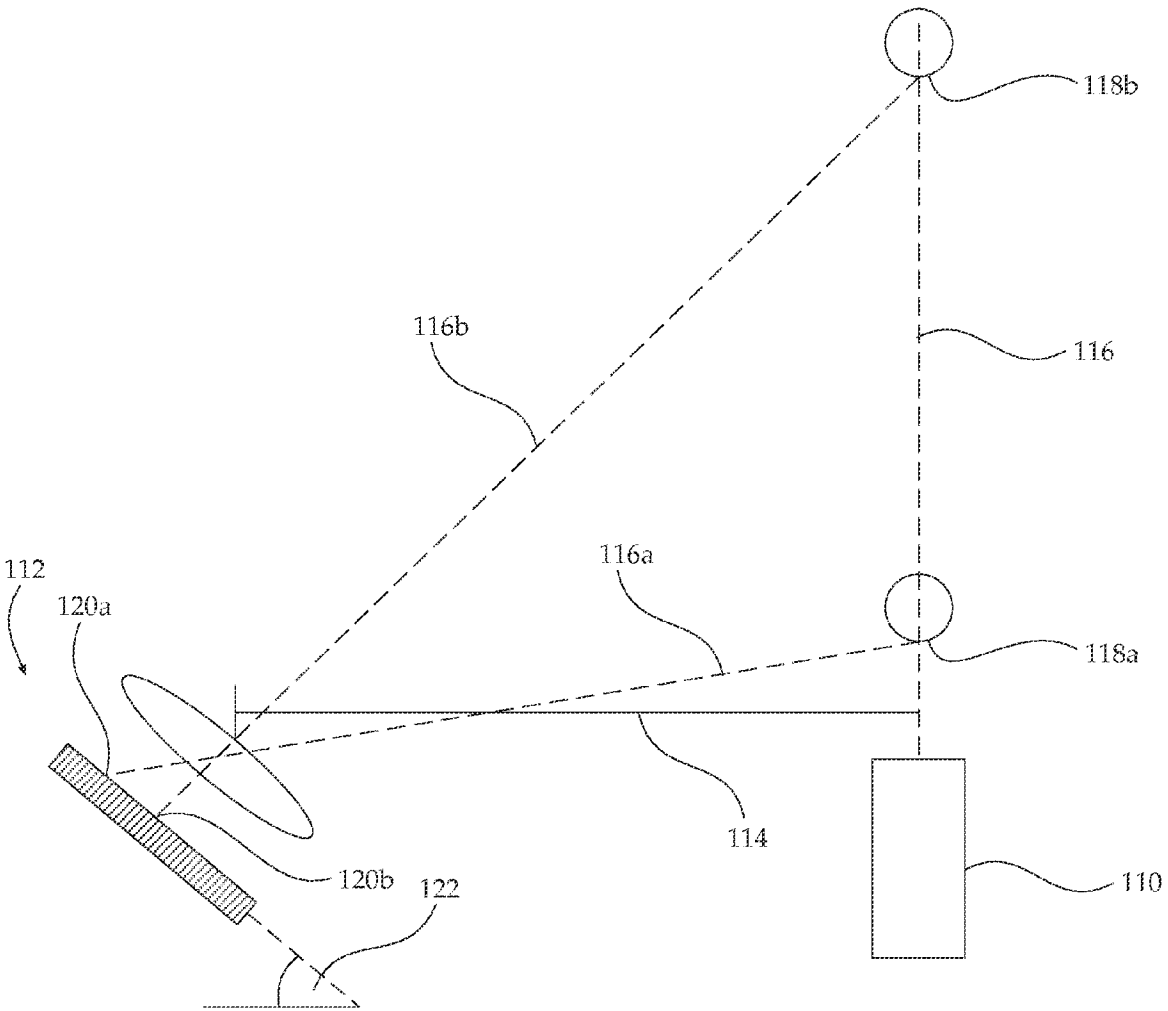
FIG. 2A (prior art)
FIG. 2A (prior art) is a schematic representation of the principles of operation of a known distance-provider.

In FIG. 2A, a distance-provider similar to the device described by Yuan and Manduchi is schematically depicted including a light-source 110 and a light-detector 112 which apertures are separated by an inter-aperture separation 114. During use, light-source 110 projects a beam of light 116. The beam of light is reflected from a reflecting object (target) 118*a* or 118*b* towards light-detector 112 according to a path, 116*a* or 116*b* respectively, that is dependent on the distance between light source 110 and object 118*a* or 118*b*, to be detected on the epipolar line of light-detector 112 at a detection location, 120*a* or 120*b* respectively, that is dependent on the distance to the respective object 118*a* or 118*b*. Vergence angle 122 (the angle at which light-detector 112 faces beam 116 projected by light-source 110) is such that light reflected from some distance (between the minimum and maximum distance to objects that the distance-provider is configured to report) is perpendicular to light-detector 12.

Figure 2B:
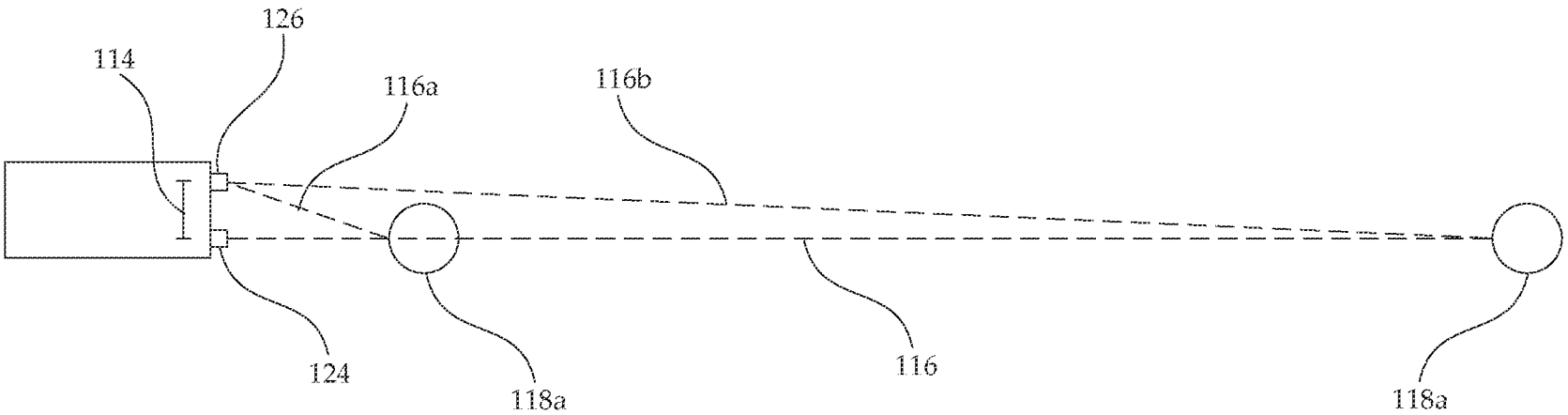
FIG. 2B is a schematic representation of the principles of operation of an embodiment a distance-provider according to the teachings herein.

In FIG. 2B, an embodiment of a distance-provider according to the teachings herein is schematically depicted where an inter-aperture separation 114 between a light-source aperture 124 and a light-detector aperture 126 is small, in accordance with the teachings herein. It is seen that when inter-aperture separation 114 is small, the vergence angle (not depicted in FIG. 2B) is much smaller then when inter-aperture separation 114 is large as in FIG. 2A. As is known to one skilled in the art and by comparing FIGS. 2A and 2B, it is qualitatively seen that distance resolution (the distance between two detection locations 120 on light-detector 112 as a function of the distance to two respective reflecting objects 118) is distance-dependent. The detection locations of two closer reflecting objects separated by given distance are further apart on light-detector 112 than the detection locations of two further reflecting objects separated by the same given distance. Consequently, all other things being equal, there is a disparity between the distance resolution to closer objects and to further objects: the distance resolution for closer objects being greater than the distance resolution for further objects. The greater the inter-aperture separation 114, the less the disparity, and conversely, the lesser the inter-aperture separation the greater the disparity.

It is generally accepted that the greater the inter-aperture separation of such a device, the greater the amount and quality of information relating to distance the device can gather. Further, inherent errors such as assembly inaccuracies and inherent inaccuracies of the components become more significant with smaller inter-aperture separation.

Despite this, it has been found that advantages of the distance-provider such as small inter-aperture separation (allowing a more compact and smaller footprint device), robustness and high rate of distance determination outweigh the high disparity between distance resolution for near and far distances.

The frame rate of the distance-provider (the rate at which the light provider measures distinct distances) can be any suitable frame rate. That said, in some embodiments the frame rate of the light-detector is as fast as possible. Thus, in some embodiments, the frame rate is at least about 55 fps (frames per second), at least about 15 fps, at least about 30 fps, at least about 40 fps, at least about 60 fps, at least about 80 fps at least about 100 fps, and even at least about 200 fps. Detectors having suitable frame rates are commercially available, for example, from Fairchild Imaging (Milpitas, Calif., USA).

In some embodiments, the distance provider is configured to produce the signal related to the detection location (and thereby the distance to the object) at a given reporting rate. The reporting rate may be any suitable reporting rate. That said, in some embodiments the reporting rate of the light-detector is as fast as possible, that in general can be no more frequent than the frame rate of the light-detector. In some embodiments, the reporting rate is faster than half the frame rate (e.g., for a frame rate of 30 fps, a reporting rate of at least about 16 Hz, for a frame rate of 60 fps, a reporting rate of at least about 31 Hz). In some such embodiments, the reporting rate is equal to the frame rate (e.g., for a frame rate of 15 fps, a reporting rate of 15 Hz, for a frame rate of 80 fps, a reporting rate of 80 Hz). In some embodiments, the distance provider is configured to produce the signal at a reporting rate faster than half the frame rate. In some embodiments, the distance provider is configured to produce the signal at a reporting rate equal to the frame rate.

In some embodiments, distance value is not acquired by comparing two or more discrete detection events and no complex calculations are needed to provide distance value. Rather, in some embodiments the distance value acquired is directly reported to a processor of a pneumatic launcher by the signal In some such embodiments, the combination of a high frame rate coupled with a high reporting rate has a number of advantages.

For example, random errors in determining the detection location on the light-detector become insignificant and are "drowned out" by the much larger number of correct determinations of detection locations.

For example, in some embodiments incidental detection of light that is not from the light-source, but from another light-source (e.g., another such distance-provider, another device such as a fire alarm, dedicated countermeasures) is insignificant as a short-lived incorrect measurement.

As noted above, in some embodiments a distance provider according to the teachings herein comprises a housing having a front end and an axis. A housing of any suitable shape and size may be used in implementing a distance-provider according to the teachings herein. In some embodiments, a small inter-aperture separation allows the housing and the distance-provider as a whole to be more portable, ergonomic and convenient, increasing the utility of the distance-provider. In some embodiments, a housing is elongated (e.g., similar to a television remote control, rifle scope or the like).

As noted above, in some embodiments a distance-provider according to the teachings herein comprises a light-source configured for projecting a beam of light through a light-source aperture in a direction from the front end of the housing that is not more than 2° divergent from parallel to the axis of the housing. In some embodiments it is preferred that the light-source projects a beam of light as close as possible to parallel to the axis so that a operator knows that a distance value is acquired substantially from where the distance-provider is aimed. Thus, in some embodiments a beam of light is projected at not more than about 1°, not more than about 0.5° and in some embodiments not more than about 0.2° from parallel to the distance-provider axis.

A light-source projecting a light beam having any suitable wavelength or combinations of wavelengths may be used in implementing a distance-provider according to the teachings herein. In some embodiments the light-source is configured to project a substantially monochromatic beam of light, allowing greater confidence that detected light is light projected by the light source and reflected from a reflecting object and, as discussed below, allowing a relative reduction of background noise.

A light-source projecting a light-beam including any suitable wavelength of light may be used in implementing a distance-provider according to the teachings herein. In some embodiments it is preferred that light projected by a light-source of a distance-provider be non-visible so as not to distract or otherwise interfere with people and animals when the device is in use, even when the light beam is relatively intense. In some such embodiments, the light source is configured to produce a light beam comprising infrared light (700 nm-1 mm), especially near-infrared light (700 nm-1400 nm), that is not ordinarily visible to humans, for example light comprising or consisting of light with a wavelength of 780 nm or 880 nm. That said, in some embodiments the light projected by a light-source of a distance-provider comprises visible wavelengths of light (390 nm-750 nm).

A light-source projecting a light-beam having any suitable cross-sectional shape may be used in implementing a distance-provider according to the teachings herein. In some embodiments, the light-source is a point light-source projecting a substantially concentrated (e.g., substantially circular) light-beam, which allows relatively easier detection.

A light-source projecting a light-beam having any suitable divergence may be used in implementing a distance-provider according to the teachings herein. In some embodiments, a greater divergence leads to a reduced distance as the intensity of reflections become too weak to be detection. In some embodiments, greater divergence leads to multiple reflections at greater distances. In some embodiments, a light-source projecting a beam having a relatively low nominal divergence is used in implementing a distance-provider according to the teachings herein, assisting in ensuring that the beam of light is reflected from only one reflecting object at a time and that the intensity of reflected light is sufficient to be detected even at greater distances. Accordingly, in some embodiments the light-beam projected by the light-source has a nominal divergence of not more than about 4 mrad, not more than about 2 mrad, not more than about 1 mrad and even not more than about 0.5 mrad.

Any suitable light-source may be used in implementing a distance-provider according to the teachings herein. For various reasons including widespread commercial availability, low-cost, sufficient intensity and low inherent divergence, in some embodiments the light-source is a laser light-source.

In some embodiments, it is preferred that the light-source be eye-safe. In some embodiments, a light-source is a Class 1 laser, that is to say, eye safe under all conditions of normal use. In some embodiments, a light-source is a Class 1M laser that is safe for use except when the light is passed through magnifying optics. In some embodiments, a light-source is a Class 2 or Class 2M laser that is safe because the blink reflex will limit exposure to a time short enough to avoid eye damage.

As noted above, in some embodiments a distance-provider according to the teachings herein comprises a light-detector configured to detect light projected by the light-source, reflected from a reflecting object located at a distance between a minimum distance and a maximum distance from the front end of the housing and entering through a light-detector aperture, at a frame rate where a detection location of the light reflected from a reflecting object on an epipolar line of the light-detector is dependent on the distance to the reflecting object.

In some embodiments, a distance-provider is configured so that only a limited range of wavelengths are detected by a light-detector, in some such embodiments substantially only a single wavelength of light. In some embodiments, a distance-provider comprises a light filter physically associated with the housing so that light reaching the light-detector passes through the light filter. In some such embodiments, the light filter is a narrow-pass light filter which allows passage of as narrow a range of wavelengths as possible without excessive attenuation in order to reduce the chance of overexposure of the light-detector and/or to reduce the intensity of the detected background and/or to reduce the chance of detection of spurious signals.

In some embodiments, a distance-provider is configured so that substantially only the wavelength of light projected by the corresponding light-source (especially when the light-source is monochromatic) can be detected by the light-detector, for example, the distance-provider comprises a light filter allowing passage of light projected by the light-source.

In some such embodiments, a factor in selecting the light-source is the availability of suitable narrow pass light filters, for example from Optics Balzers AG (Balzers, Liechtenstein). For example, narrow pass filters for light of 780 nm or 880 nm are readily commercially available.

That said, in some embodiments, a distance-provider is also used to acquire an image as described above, so a light filter, if present preferably does not adversely affect image-acquisition.

A light-detector having any suitable angle of view may be used in implementing a device according to the teachings herein. Generally, the angle of view is sufficiently large to allow acquisition of light reflected from reflecting objects both at the minimum distance and at the maximum distance. As is clear to one skilled in the art and as is seen by comparing FIGS. 2A and 2B, the smaller the inter-aperture separation, the smaller the required angle of view to acquire light reflected from reflecting objects at both the minimum distance and the maximum distance. A smaller angle of view has a number of advantages including reducing noise, reducing the detection of spurious signals (e.g., from a similar distance-provider or other type of device being used in the same area), and reducing the chance of the light-detector being over exposed. Thus, in some embodiments, the small inter-aperture separation allows the light-detector to have a small angle of view.

In some embodiments, the angle of view of the light-detector is not more than ten times, not more than eight times, not more than four times, not more than twice and even not more than 1.5 times the minimal angle of view required to acquire light reflected from a reflecting object at the minimum distance and from a reflecting object at the maximum distance.

In some embodiments, the angle of view of the light-detector is not more than about 10°, not more than about 8°, not more than about 5° and even not more than about 4°.

In some embodiments, an advantage of a small inter-aperture separation is (as seen from FIGS. 2A and 2B) that the angle at which light reflected from reflecting objects impinges on a light detector changes significantly less as a function of the distance to a reflecting object. For example, it can be shown that in a distance-provider having an inter-aperture separation of 3 cm, light reflected from a far object at 500 cm impinges at 89.66° and light reflected from a near object at 50 cm, impinges at 86.57°, a difference of only 3.09°. Consequently, a light-detector vergence angle can be selected so that light reflected from all objects between the minimum and maximum distance impinges on a light-detector relatively close to perpendicular, increasing detection efficiency and reducing instances of "glancing" light where reflected light is detected at a plurality of detection locations. Thus, in some embodiments, the vergence angle of the light-detector is not more than 10°, not more than 7°, not more than 5° and even not more than 3° from parallel to the direction at which the light beam is projected.

In some embodiments, the light-detector vergence angle is selected so that light reflected by an object somewhere between the minimum and maximum distance, is perpendicular to the light-detector.

In some embodiments, the light-detector vergence angle is selected so that light reflected by an object at the minimum distance and by an object at the maximum distance impinge on the light-detector at the same angle (with opposite signs). For example, in an embodiment of an inter-aperture separation of 3 cm, the vergence angle is 88.11° so that light reflected from an object 500 cm distant and from an object 50 cm distant both impinge on the light-detector at about 1.55°.

In some embodiments, the light-detector vergence angle is substantially 0°, that is to say, the light-detector is directed substantially in parallel to the direction of the light beam (and the light-detector aperture and the light-source aperture face the same direction). Such embodiments have the advantage of relatively simple construction as there is no need to carefully place the light-detector at a desired vergence angle. Although not ideal, as a result of a small inter-aperture separation the lack of ideality has little practical significance. For example, in the case of an inter-aperture separation of 3 cm, light reflected from an object at 50 cm impinges on the light-detector at about 3.43°.

An additional advantage of a small inter-aperture separation and small vergence angle is that there is no need for an artificial upper limit for the maximum distance, e.g., due to a limited angle of view. Although a distance-provider is generally designed to have a given maximum distance, with a small inter-aperture separation and small vergence angle, a distance-provider can effectively determine distances at greater distances (e.g., greater than 20 meters, greater than 50 meters, greater than 100 m) that are not at an infinite distance.

As noted above, the distance provider is configured to produce a signal that is provided to the processor that is a function of the detection location of reflected light on the epipolar line of the light-detector, where the detection location is dependent on the distance to the reflecting object. A light-detector having any suitable resolution along the epipolar line between the detection location of light reflected from the minimum distance and the detection location of light reflected from the maximum distance may be used. In some embodiments, along the epipolar line between the detection location of light reflected from a reflecting object at the minimum distance and the detection location of light reflected from a reflecting object at the maximum distance there are at least about 20 distinct detection locations, at least about 100, at least about 200, at least about 300, at least about 400 and even at least about 600 distinct detection locations.

Generally, all things being equal, the greater the resolution of the light-detector along the epipolar line (that is to say, the greater the number of distinct detection locations) the better, as this provides a greater distance resolution. That said, a very high resolution may have a negative influence in terms of higher price, lower frame rate and reduced light sensitivity at each detection location. That said, and as discussed below, these factors are generally insignificant in practical terms.

Any type of light-detector may be used in implementing a device according to the teachings herein. In some embodiments, a light-detector is a pixelated light-detector comprising a plurality of individual light-detecting elements, e.g., a CMOS or CCD light-detector. In some embodiments, a CMOS light-detector is preferred as some embodiments of such detectors have a lower power usage and/or have a higher frame rate and/or have an output that is more readily useable without further processing. In some embodiments, a CCD light-detector is preferred as some embodiments of such detectors have a lower noise and/or a greater dynamic range.

In some embodiments, the light-detector comprises a two-dimensional array of individual light-detecting elements. As discussed in Yuan and Manduci, when a light-detector is a two-dimensional array of individual light detecting elements, most of the light-detecting elements are not used for implementing the teachings herein. Rather, after assembly and periodically, the distance-provider is optionally calibrated by determining which light-detecting elements are located along the epipolar line of the light-detector (generally a line of single light-detecting elements, or a band a few light-detecting elements broad) and only these light detecting elements need to be interrogated when determining a detection location.

In some embodiments, a group of individual light-detecting elements of a light-detector array define a single detection location. In some embodiments, a single light-detecting element of a light-detector array defines a single detection location. In some embodiments, a detection location is smaller than a single light-detecting element, for example by implementing a super-resolution algorithm.

As is known to a person having ordinary skill in the art, 3.1 megapixel CMOS and CCD light-detectors having a two-dimensional array of 2048×1536 light-detecting elements are readily available at low prices, have high-speed and a good sensitivity. Even 20 megapixel CMOS and CCD light-detectors having a two-dimensional array of 3600×5400 light-detecting elements are readily available. If positioned so that the epipolar line is along the diagonal of such a detector, it is a simple matter to attain a resolution of more than 6200 distinct location. It is thus clear that a desired light-detector resolution is practically implementable with little effort.

In some embodiments, a distance-provider further comprises a lens to direct the reflected light to the light-detector. In some embodiments, the lens is a telephoto lens and even a super telephoto lens, assisting in implementing a small angle of view allowed by the small inter-aperture separation, and improving utility of the distance-provider to determine distances in excess of 10 m, and even in excess of 20 m.

Seemingly, the use of a telephoto lens or a super telephoto lens is undesirable as such lenses have a very shallow depth of field. A very shallow depth of field means that except for light coming from objects at a narrow distance of "in-focus" distances, most light entering the lens is not focused onto the light detector but is distributed over a relatively large area of the light detector. Implementing a focusing functionality to such a lens so that reflected light is focused onto the light detector adds complexity, makes the device expensive and significantly reduces the frame rate of the device. It has been found that in some embodiments the shallow depth of field of such lenses is advantageous: in some embodiments interference by background light is reduced by distributing the background over a large number of light-detecting elements and detection locations. That said, in some embodiments, a distance report includes a lens with a focusing functionality, for example as known in the art of digital photography In some instances, reflected light is not located at a clearly-defined detection location. For example, due to the divergence of the light beam, in some instances the reflected light is detected on a relatively large area of the light detector by a plurality of (adjacent) individual light-detecting elements that correspond to two or more distinct detection locations. Such a problem is aggravated in embodiments when the distance provider is devoid of a focusing capability, especially a device having a shallow depth of field such as with a telephoto or super telephoto lens.

Thus, in some embodiments, a distance-provider further comprises: a distance-provider processor functionally associated with the light-detector, configured to identify a detection location, for example, from a plurality of light-detecting elements of the light detector on which reflected light has been detected. In some embodiments, the processor is configured to identify a detection location from a plurality of locations of the light-detector on which the reflected light has been detected. A person having ordinary skill in the art is capable of implementing a simple center-finding algorithm that identifies a detection location as the center of a group of locations (e.g., separate light-detecting elements or distinct detection locations) of the light-detector on which the reflected light has been detected that is independent of the size of the group (due to lack of focus or light-beam divergence) and the shape of the group (e.g., resulting from reflection from an angled reflecting object). Importantly, in some embodiments, even if in some instances the processor incorrectly determines the center of a group of locations as a detection location, the high frame rate of a light-detector means that preceding and succeeding correct determinations render the incorrect determination of the detection location insignificant. In some embodiments, the processor is the processor used by the pneumatic launcher. In some embodiments, the processor is a dedicated distance-provider processor.

In some embodiments discussed above, the light-source is a point light-source and the light-detector is a two-dimensional array of light-detecting elements. As is clear to one skilled in the art, the teachings herein can be implemented using a line light-source and a light-detector that is a linear array of light-detecting elements, analogous to those discussed in Yuan and Manduci. In some embodiments, linear arrays of light-detecting elements allow a higher frame rate and higher sensitivity than two-dimensional arrays. That said, such embodiments may be less preferred as each point along the line of light projected of the line light-source has a low intensity compared to a point light-source and does not practically allow implementation of image-acquisition functionality.

As noted above, in some embodiments a distance-provider according to the teachings herein comprises a distance provider functionally associated with the light-detector, configured to produce a signal related to the detection location at a reporting rate, the signal suitable for providing as a distance value to the processor of the pneumatic launcher according to the teachings herein. In some embodiments, a distance provider comprises a processor such as a digital processor.

In some embodiments, the distance provider is configured to provide the signal to the processor of the pneumatic launcher at a reporting rate faster than half the frame rate. In some embodiments, the distance provider is configured to provide the signal to the processor of the pneumatic launcher at a reporting rate equal to the frame rate, for example, if the frame rate is 30 fps, the reporting rate is 30 Hz, and if the frame rate is 40 fps, the reporting rate is 40 Hz.

In some embodiments, a light-source of a distance-provider according to the teachings herein is configured to project a continuous beam of light.

In some embodiments, a light-source of a distance-provider according to the teachings herein is configured to produce a flashing beam of light having a time-varying intensity synchronized with the light-detector frame rate. Such flashing increases the complexity of the distance-provider, but also reduces the chance that light from a different such distance-provider or countermeasure will be mistakenly identified as a reflection from a reflecting object. In some embodiments, such flashing allows the peak intensity of the beam to be increased without compromising safety.

Figure 3:
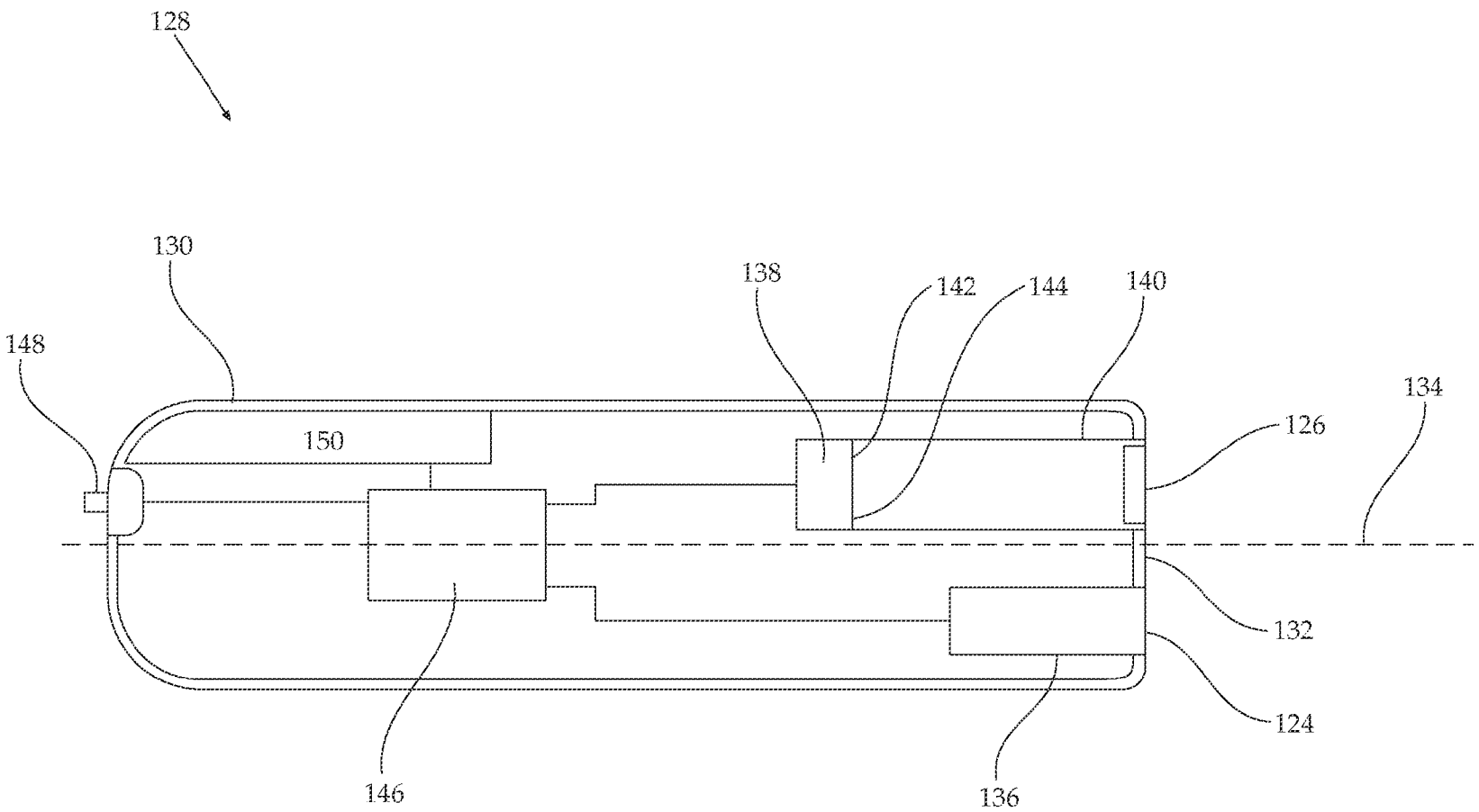
FIG. 3 is a schematic representation, in cross section, of a distance provider according to the teachings herein.

In some embodiments, a distance-provider according to the teachings herein comprises a portable power source physically associated with the housing for supplying power required for operation of other distance-provider components such as the light-source and the light-detector. Typical power sources include batteries, especially rechargeable batteries (e.g., Li-Ion or Li—Ni rechargeable batteries), and fuel cells. In FIG. 3, an embodiment of a distance-provider 128 is schematically depicted.

Distance-provider 128 comprises an elongated housing 130 having a front end 132 and an axis 134.

Contained inside housing 130 and thus physically associated therewith is a light-source 136 with a light-source aperture 124. Light source 136 is a class I near-infrared laser configured for projecting a continuous beam of substantially monochromatic light with a wavelength of 780 nm and a beam divergence of 0.5 mrad. Light source 136 is secured so that the projected beam of light is projected substantially in parallel to axis 134.

Also contained inside housing 130 and thus physically associated therewith is a light detector 138, a 3600×5400 (20 megapixel) two-dimensional CCD array having a 60 fps frame rate known in the art of digital photography able to detect, inter alia, light having a wavelength of 780 nm, available, for example from Vision Research Inc. (Wayne, N.J., USA). Light-detector 138 is mounted perpendicularly to axis 134 and therefore has a vergence angle of 0°. Light-detector aperture 124 is separated by 3 cm from light-source aperture 124. Light-detector 138 is functionally associated with a telephoto lens 140 having an angle of view of 6°. Telephoto lens 140 and light-detector 138 are mounted so that light projected by light source 136 and reflected from an object at a minimum distance of 50 cm is detected at a first detection location 142 (entering light-detector aperture 126 at an angle of 86.57°) and light reflected from an object at a maximum distance of 50 m is detected at a second detection location 144 (entering light detection aperture at an angle of 89.97°). In this context, it is important to note that the angles and marking of detection locations 142 and 144 in FIG. 3 are distorted for clarity. The epipolar line between first detection location 142 and second detection location 144 includes 5000 pixels, each constituting a distinct detection location.

Contained inside housing 130 is a processor 146 (a general purposed microprocessor) functionally associated with light source 136, light detector 136, and communication port 148 allowing distance values determined by distance provider 128 to a processor of a suitable pneumatic launcher, such as processor 36 of launcher 10 depicted in FIG. 1. Processor 146 draws power from a power source 150 (a rechargeable battery) and distributes power as needed to the other components of distance provider 128.

Processor 146 is configured for controlling operation of light-source 136 and light-detector 138, including calculating a detection location along the epipolar line of light detector 138 as the center of a group of pixels that detect light projected from light source 136, being reflected from a reflecting object, and entering light-detector aperture 126.

Processor 146 is also configured to function as a distance provider, to produce a signal related to a detection location and thereby a distance to an object and to provide the signal (using communication port 148) to a processor 36 of a pneumatic launcher 10 such as depicted in FIG. 1 at a reporting rate of 60 Hz that is equal to the 60 fps frame rate. Specifically, processor 146 is configured so that each of the 5000 distinct detection locations corresponds to a different distance from 50 cm to 50 m.

For use, housing 130 of distance-provider 128 is mounted on a pneumatic launcher such as 10.

Analogous to the depicted in FIG. 2B, processor 146 provides power to light-source 136 to produce a beam of light 116 exiting from light-source aperture 124 in parallel to axis 134. When beam of light 116 is reflected by a reflecting object between the minimum distance and the maximum distance, the reflected light enters through light-detector aperture 126 and is directed by telephoto lens 140 to a location on light-detector 138 to illuminate an area on and around the epipolar line of light-detector 138 consisting of one or more individual light-detecting elements (pixels).

At the frame rate, processor 146 calculates which pixel on the epipolar line corresponds to the center of the illuminated area and designates that pixel as the current detection location. Processor 146 sends an electronic signal at the reporting rate to processor 36 of pneumatic device 10 as a distance value. Processor 36 receives the distance value and controls valve 30 as a function of the distance value, to propel a projectile with a launch power that is dependent on the distance value.

The teachings herein are applicable for pneumatic launchers configured for launching projectiles through air, for pneumatic launchers configured for launching projectiles though water and for pneumatic launchers configured for launching projectiles though vacuum.

It is appreciated that certain features of the invention, which are, for clarity, described in the context of separate embodiments, may also be provided in combination in a single embodiment. Conversely, various feature is of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

The invention claimed is:

1. A pneumatic launcher for launching a projectile at a target, comprising:

a) a chamber configured for holding a projectile prior to launching;

b) functionally associated with said chamber, a barrel defining a bore configured for guiding a said projectile launched from said chamber in a desired direction;

c) a propellant conduit for directing a gas propellant into said chamber to propel a said projectile from said chamber and out of said barrel, thereby launching said projectile;

d) functionally associated with said chamber and/or said propellant conduit, a regulating mechanism configured to regulate at least one characteristic of gas propellant that effects a launch power with which said projectile is propelled from said chamber;

e) a digital processor configured to control said regulating mechanism as a function of a distance and also based on the detection of a face, to propel a said projectile with a distance-dependent launch power calculated to impact a target with a desired force; and f) a distance-provider functionally associated with said processor, configured to provide to said processor a distance value wherein said distance value is a distance to an object at which the pneumatic launcher is aimed, wherein a said characteristic of said gas propellant is additionally determined based on whether or not the pneumatic launcher is aimed at a face, and wherein said desired force is a force selected to reduce the chance of injurious impact to a target located at a said provided distance value.

2. The launcher of claim 1, wherein a said characteristic of gas propellant that said regulating mechanism is configured to regulate is at least one characteristic selected from the group consisting of a pressure of a gas propellant directed into said chamber and an amount of a gas propellant directed into said chamber.

3. The launcher of claim 1, further comprising a trigger functionally associated with said processor and said distance-provider, configured so that when said trigger is activated, said distance-provider determines a said distance value, provides said determined distance value to said processor and said processor controls said regulating mechanism to propel a said projectile with a distance-dependent launch power.

4. The launcher of claim 3, configured so that said propelling a said projectile is not more than about 0.5 seconds after said trigger is activated.

5. The launcher of claim 3, wherein said trigger has at least two user-determined states:

a distance-determining state where said distance-provider repeatedly determines a said distance value at a distance-determining rate; and a firing state, wherein said processor controls said regulating mechanism to propel a said projectile with a said distance-dependent launch power based on a distance value most-recently determined by said distance-provider.

6. The launcher of claim 5, wherein said distance-determining rate is not less frequent than about 1 Hz.

7. The launcher of claim 5, configured so that said propelling a said projectile is not more than about 0.5 seconds after entry of said trigger to said firing state.

8. The launcher of claim 1, further comprising an ambient thermometer functionally associated with said processor, configured to determine and provide an ambient temperature to said processor; and wherein said processor is configured to control said regulating mechanism also as a function of said ambient temperature.

9. The launcher of claim 1, further comprising a chamber thermometer functionally associated with said processor, configured to determine and provide a chamber temperature to said processor; and wherein said processor is configured to control said regulating mechanism also as a function of said chamber temperature.

10. The launcher of claim 1, further comprising an ambient pressure measuring barometer functionally associated with said processor, configured to determine and provide an ambient pressure to said processor; and wherein said processor is configured to control said regulating mechanism also as a function of said ambient pressure.

11. The launcher of claim 1, further comprising a barrel elevation provider functionally associated with said processor, configured to determine and provide an elevation of said barrel to said processor; and wherein said processor is configured to control said regulating mechanism also as a function of said barrel elevation.

12. The launcher of claim 1, wherein said distance-provider includes an image acquirer configured to acquire an image of a target at which said barrel is aimed.

13. The launcher of claim 11, wherein said distance-provider includes a light-source oriented so that a reflection of a beam of light produced by said light source from a target at which said barrel is aimed is detectable by said image acquirer.

14. The launcher of claim 12, wherein said processor is configured to detect the presence of a face in said image; and wherein said processor is configured to control said regulating mechanism also based on the detection of a face in said image.

15. The launcher of claim 1, further comprising a dynamic gun-sight functionally associated with said processor, said gun-sight configured to have at least two states, each state indicating a different elevation at which said barrel is to be oriented, wherein said processor is configured to control the state of said gun-sight relative to said launch power.

16. A method of launching a less-than lethal projectile at a target, comprising:

a) providing a pneumatic launcher with a barrel and a chamber holding a projectile b) aiming said pneumatic launcher at a target;

c) determining a distance from said pneumatic launcher to where said pneumatic launcher is aimed; and d) subsequent to 'c', releasing a gas propellant into said chamber of said pneumatic launcher to launch said projectile through said barrel not more than about 0.5 seconds after said determining of said distance, wherein the characteristics of said gas propellant released into said chamber are at least partially based on said determined distance, and on whether or not the pneumatic launcher is aimed at a face, so that the launch power with which said projectile is propelled from said chamber is such that said projectile impacts said target with a desired force selected to reduce the chance of injurious impact.

17. The method of claim 16, wherein said characteristics of said gas propellant released into said chamber are additionally determined based on at least one other factor selected from the group consisting of ambient temperature, chamber temperature, ambient pressure and barrel elevation.

18. The method of claim 16, wherein said determining a distance from said pneumatic launcher to an object at which said pneumatic launcher is aimed is repeated determination at a distance-determining rate prior to said releasing; and said releasing a gas propellant into said chamber of said pneumatic launcher to launch said projectile through said barrel is based on a most-recently determined distance.

19. The method of claim 18, wherein said distance-determining rate is not less frequent than about 1 Hz.

* * * * *